United States Patent [19]

Krautkrämer

[11] Patent Number: 4,997,097

[45] Date of Patent: Mar. 5, 1991

[54] SCREW CLOSURE FOR BOTTLES WITH VENTING MEANS

[75] Inventor: Günter J. Krautkrämer, Budenheim, Fed. Rep. of Germany

[73] Assignee: Jacob Berg GmbH & Co., Fed. Rep. of Germany

[21] Appl. No.: 439,998

[22] Filed: Nov. 21, 1989

[30] Foreign Application Priority Data

Nov. 22, 1988 [DE] Fed. Rep. of Germany ..... 3839351

[51] Int. Cl.[5] ..... B65D 51/16

[52] U.S. Cl. ..... 215/307; 215/260; 215/310

[58] Field of Search ..... 215/260, 262, 270, 307, 215/310, 341, 261, 351, 311, 349

[56] References Cited

U.S. PATENT DOCUMENTS

| | | | |
|---|---|---|---|
| 3,966,071 | 6/1976 | Northup | 215/307 |
| 4,007,848 | 2/1976 | Snyder | 215/307 |
| 4,121,728 | 10/1978 | Tagalakis et al. | 215/260 |
| 4,427,126 | 1/1984 | Ostrowsky | 215/307 |
| 4,738,370 | 4/1988 | Urmston et al. | 215/307 |
| 4,747,502 | 5/1988 | Luenser | 215/307 |

FOREIGN PATENT DOCUMENTS

| | | | |
|---|---|---|---|
| 767987 | 9/1967 | Canada | 215/310 |
| 55916 | 7/1982 | European Pat. Off. . | |

*Primary Examiner*—Stephen Marcus
*Assistant Examiner*—Vanessa M. Roberts
*Attorney, Agent, or Firm*—Biebel, French & Nauman

[57] ABSTRACT

The invention relates to a screw closure of plastics material for bottles which are under pressure, comprising a cap (1) having a cap end portion (2) and a substantially cylindrical peripheral cap portion (3) with internal screwthread (7), and a circumferentially extending, inwardly projecting bead (5) at the transition between the cap end portion (2) and the peripheral cap portion (3), wherein a sealing disc (9) which is movable relative to the cap bears against the inward side of the cap end portion (2) and the projecting bead (5). In order, in regard to such a pressure-tight closure, to limit the maximum pressure up to which the closure remains pressure-tight, to a value which is noticeably below the pressure at which a bottle explodes, it is proposed in accordance with the invention that the bead has a segment-like interruption.

20 Claims, 4 Drawing Sheets

Figure 1:
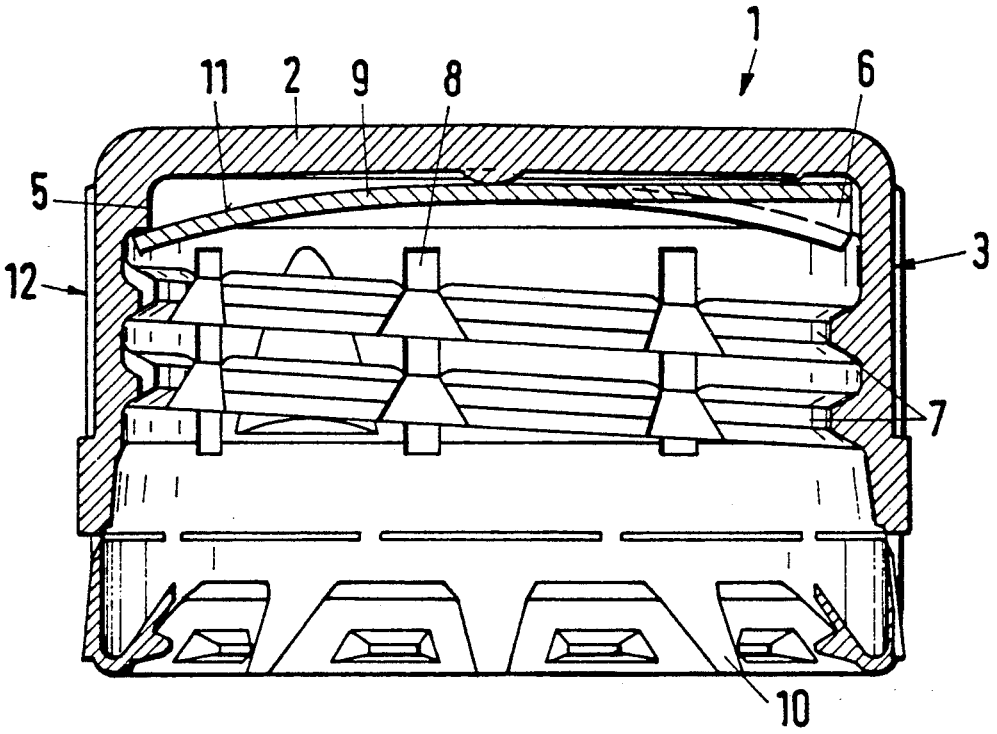

9
6'
A
A 9
6'

SCREW CLOSURE FOR BOTTLES WITH VENTING MEANS

The present invention relates to a screw closure for bottles which are under pressure, comprising a cap having a cap end portion and a peripheral cap portion with an internal screwthread, wherein screw closures of that kind generally comprise plastics material and have a circumferentially extending, inwardly projecting bead at the transition between the cap end portion and the peripheral cap portion, and wherein a sealing disc which is movable relative too the cap bears against the inward side of the cap end portion and the bead. The bead is for example substantially rectangular in cross-section and, when a screw closure is firmly screwed onto a bottle, the inwardly projecting edge of the bead is disposed in substantially diagonally opposite relationship to the upper outer edge of the mouth of the opening of the bottle. A closure of that kind is known from EP-A-OO 55 916. In that arrangement, a narrow location is formed between the projecting edge of the bead and the upper outer edge of the mouth of the opening of the bottle so that in that region an interposed sealing disc is particularly strongly subjected to pressure, with a high specific pressure in relation to surface area, and thus pressure-tightly closes the bottle. For that reason in particular bottles with carbon dioxide-bearing drinks are provided with screw closures of that kind.

A disadvantage of those pressure-tight screw closures however is that, in situations in which an excessively high pressure is unintentionally built up in the interior of the bottle, the bottle can explode. Such situations have been encountered many times in the past, and some people have suffered from serious injuries due to exploding bottles.

The present invention is therefore based on the problem of so redesigning the closure disclosed in EP-A-OO 55 916 that although it is still pressure-tight for the usual purposes of use, the maximum pressure up to which the closure remains pressure-tight is however limited to a value which is clearly below the value at which a bottle explodes.

That problem is solved in that the bead has a segment-like interruption.

The bead which extends around the cap in the manner of a circular ring in the corner formed between the cap end portion and the peripheral cap portion does therefore not extend over the entire inner circumference of the cap end portion or the peripheral cap portion, but is interrupted or omitted over a given angular region, that is to say in a segment of the ring. That segment then does not have the high contact pressure along the oppositely disposed edge lines of the bead and the closure edge of the bottle.

In that respect the sealing discs used are of sufficient stiffness so that over the interruption segment they still bear pressure-tightly against the edge of the closure edge portion of the bottle. If however the pressure in the bottle becomes too great, the sealing disc yields in the region of that segment and is pressed into the region of the transition between the cap end portion and the peripheral cap portion in which said bead is otherwise disposed in the area of the remainder of the circumference. In that situation an increased pressure can escape between the sealing disc and the closure edge portion of the bottle, and that is still further facilitated by virtue of the fact that in the preferred embodiment of the invention the screwthread of the closure has venting passages which extend transversely with respect to the screwthread pitches. Likewise the screwthread at the closure edge portion of the bottle may also have venting passages which extend transversely with respect to the screwthread.

It has been found in practice that the segment-like interruption in the bead should extend over an angular region of at least 15° to provide for the desired function of the novel screw closure, with the sealing discs which are usually employed.

On the other hand however it should also extend over an angular region which is smaller than 60° as otherwise it is not possible to ensure that the closure is pressure-tight under normal conditions.

Preferred are embodiments of the screw closure in which the segment-like interruption extends over an angle of 30° or 45°, the specific choice also depending on the nature of the sealing disc used and the maximum pressure desired. If the sealing disc is relatively thin and at the same time highly flexible and elastic, then generally the bead will be interrupted only over a smaller angular region which under some circumstances may also fall below the specified value of 15°, when using very thin and very elastic sealing discs.

Irrespective of the angular region which is specifically selected, it is also possible selectively to provide a plurality of such interruptions along the circumference of the bead. In that connection, from the point of view of proper functioning, it seems most meaningful for the interruption segments each to extend over equal angular regions and also to be spaced from each other at respectively equal angles.

However, the effect of the novel closure may also be achieved in another fashion, even if the bead is not interrupted or if another screw closure, for example made of metal, is used, which provides the pressure-tight sealing effect by virtue of the sealing disc pressing against the closure edge portion of the bottle over a greater or lesser area. Therefore, as necessary and known components, such a closure comprises a cap having a cap end portion and a peripheral cap portion with internal screwthread, as well as a sealing disc. Instead of an opening at a bead, in such a case, to solve the problem of the invention, it is proposed that, on its top side which is towards the cap end portion and possibly also the peripheral cap portion, in its region in which it is in contact with the edge of the mouth opening of the bottle, the sealing disc has at least one recess. When the closure is pressure-tightly screwed on, the sealing disc is compressed in its outer region between the closure edge portion of the bottle and the cap end portion or the peripheral cap portion respectively. If the sealing disc is provided with a recess or depression on its top side which is towards the cap end portion or the peripheral cap portion, then in that region in which it is thinner by virtue of that recess than in the remaining sealing region thereof, the sealing disc is not compressed or is compressed to a lesser extent so that in this case also, when there is a suitably high pressure in the bottle, the sealing disc is lifted away from the edge of the mouth opening of the bottle, in the region of the recess, so that the pressure can escape. In this case also additional vent passages may again be provided in the screwthread region.

Therefore, the provision of a recess on the top side of the sealing disc, in a similar manner to the segment-like interruption of the bead on a pressure-tight closure, provides that a weak location through which an excessively high pressure can escape is produced in the pressure-tight connection between the closure and the bottle.

It will be appreciated that the sealing disc does not have to be in the form of a full circular disc, but in any case it would be sufficient for a seal for example in the form of a circular ring to be arranged in the region of the closure edge portion of the bottle, in the cap.

The angular region along which a recess is to extend in the surface of the sealing disc is somewhat smaller than the angular region provided for the segment-like interruptions in a bead, but on the basis of practical experience it should be at least 10°. In the preferred embodiment such a recess in the region of the outer edge of the sealing disc extends over an angular region of 15° to 35°.

In that connection it appears to be advantageous in regard to functioning of the closure for the depth of the recess to correspond at least to half the thickness of the sealing disc. In a situation involving a more or less linear contact pressure, as for example when using the above-described bead, the sealing disc is often compressed to distinctly less than half its thickness elsewhere so that, even when the sealing disc in the region of the recess is only half as thick as in the remaining region or even thinner, there is still an adequate contact pressure to provide a sealing effect in relation to a low increased pressure which is to be tolerated. At the same time however the sealing disc can yield in that thinner region if the pressure in the bottle rises noticeably.

An advantageous embodiment of the closure also provides that a plurality of recesses are disposed along the circumferential region of a sealing disc, in which respect it may be advantageous if those recesses are similar, that is to say they are of the same depth and each extend over respectively equal angular regions and are also arranged at equal angular spacings relative to each other.

Figure 2:
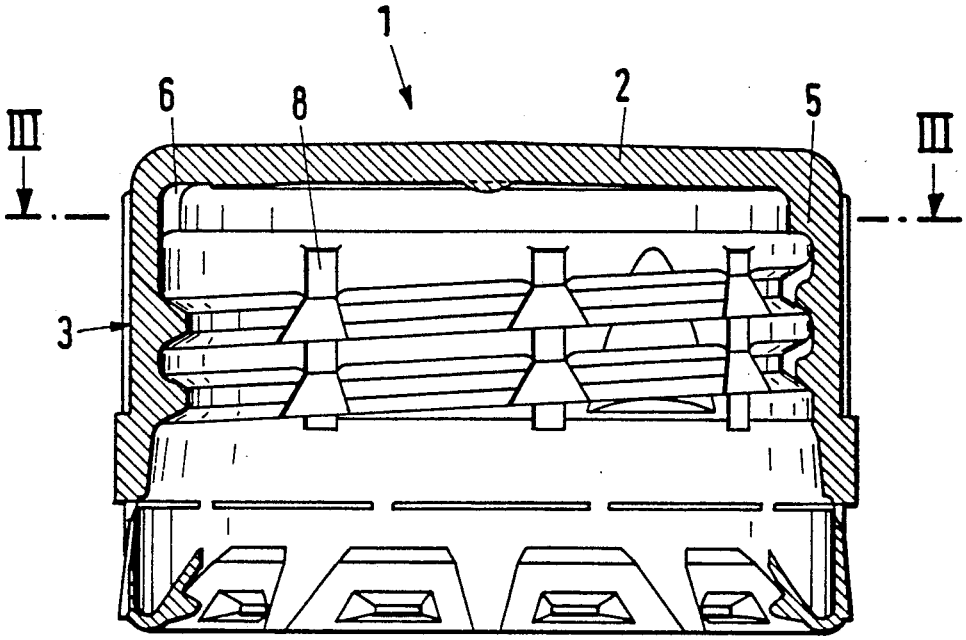
Figure 3:
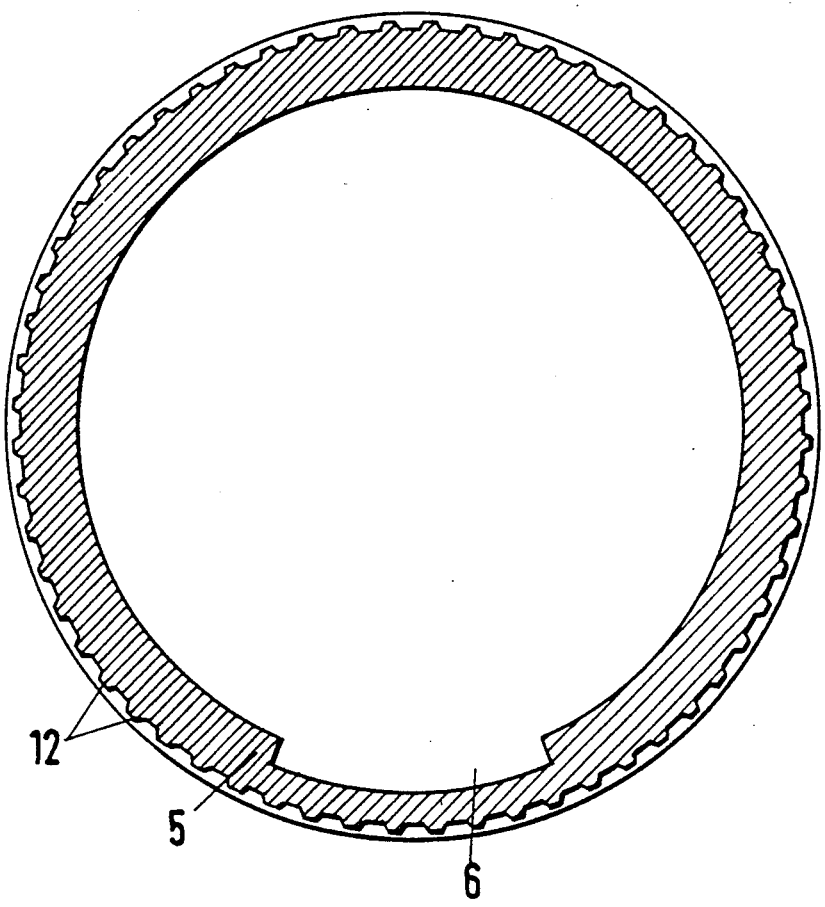
Figure 4:
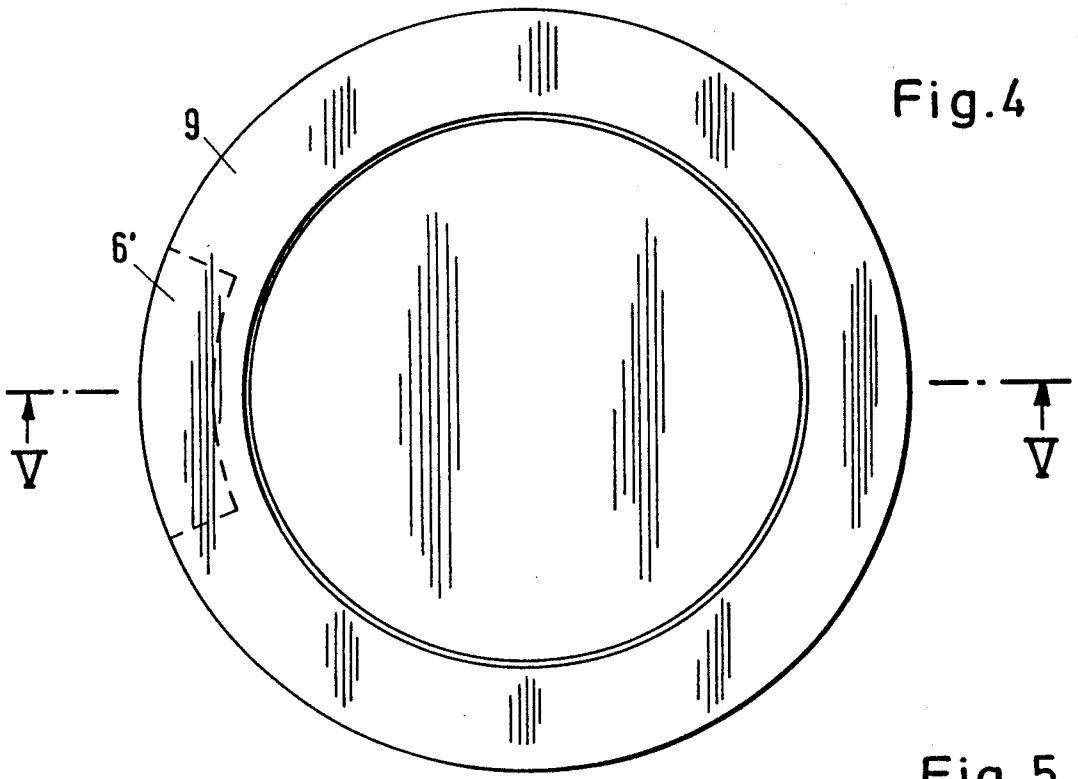
Figure 5:
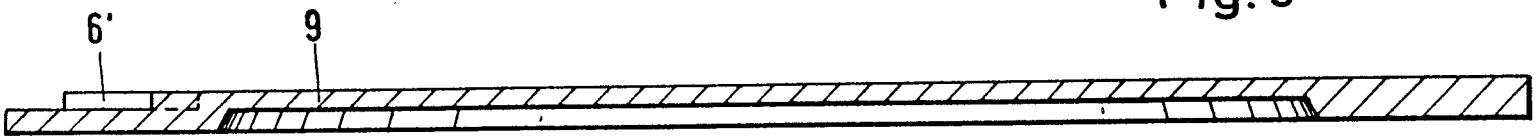
Figure 3:
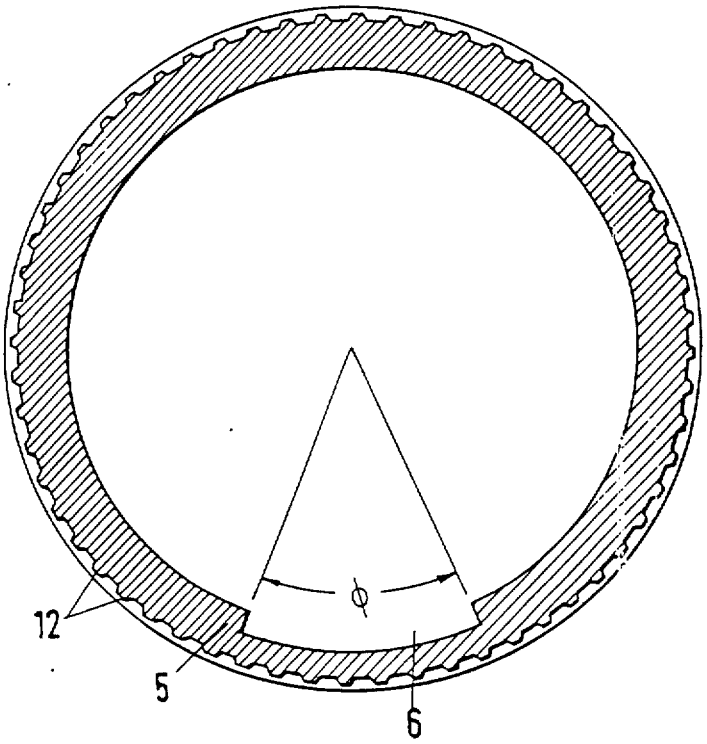
Figure 3A:
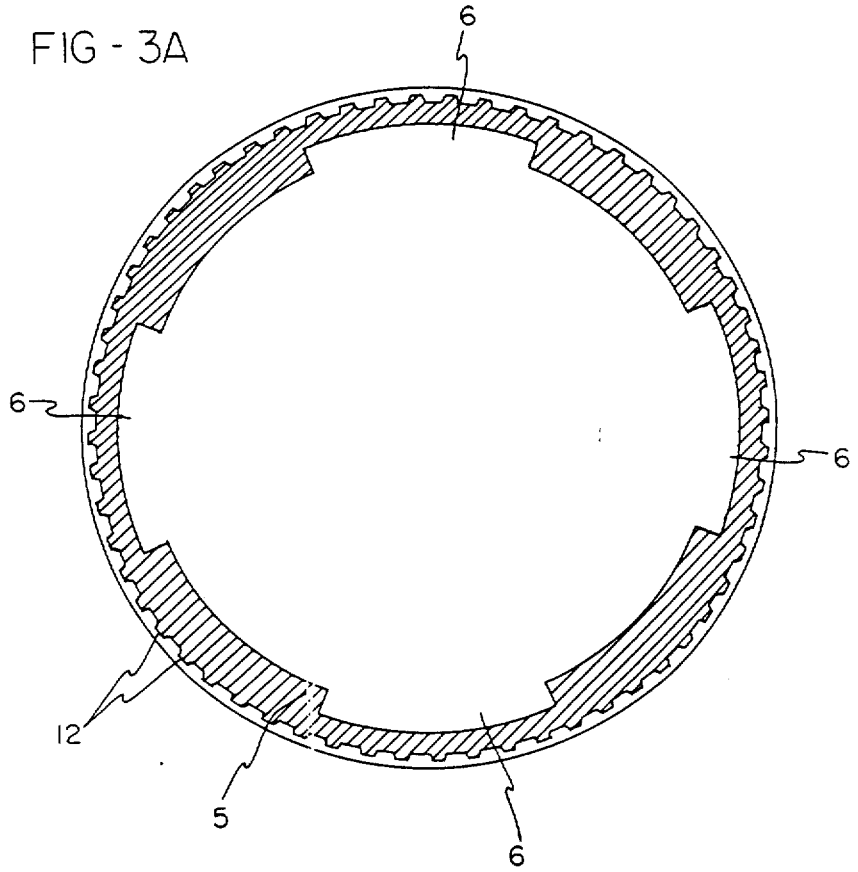
Figure 4:
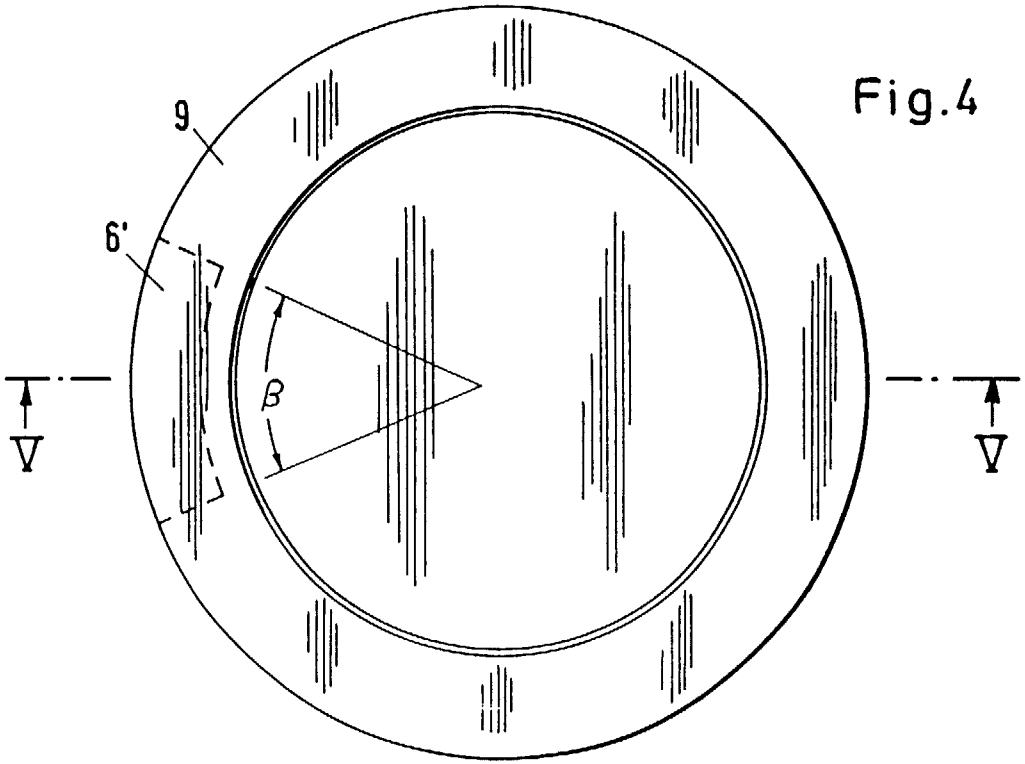
Figure 4A:
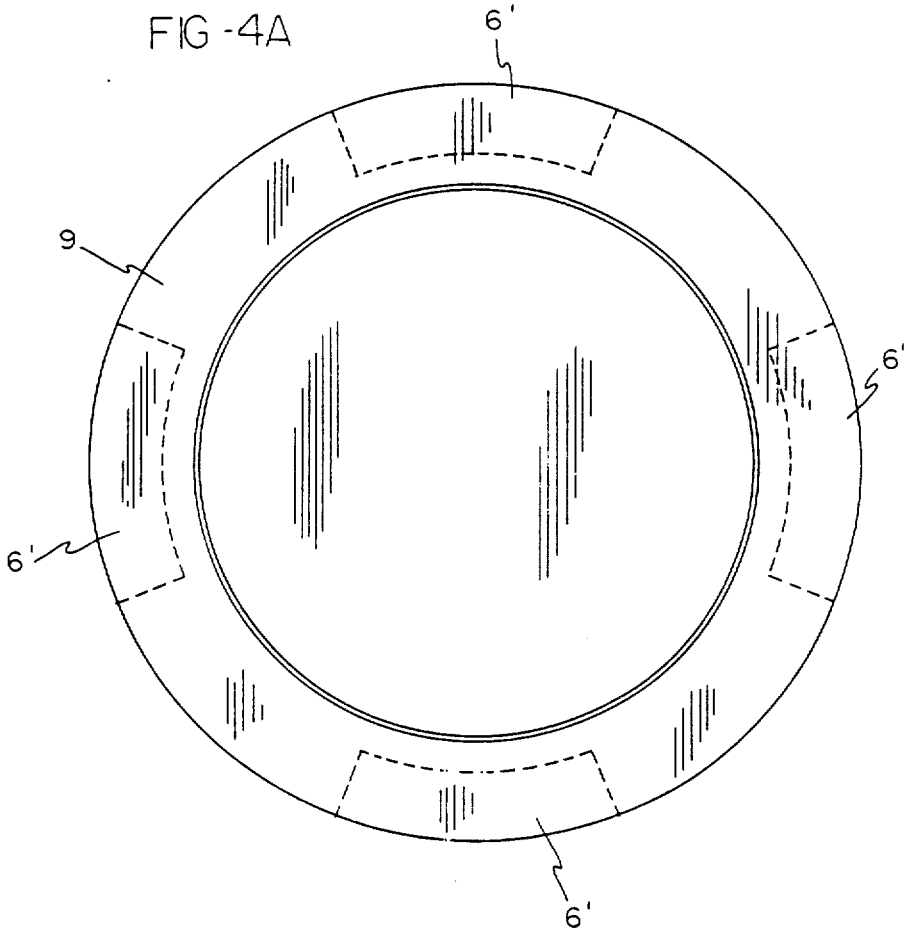

Further advantages, features and possible uses of the present invention will be clear with reference to the description of a preferred embodiment and the accompanying drawings in which:

FIG. 1 is a view in cross-section through a closure with bead and interruption segment, FIG. 2 is a view corresponding to that shown in FIG. 1, without a sealing disc, FIG. 3 is a view of the bead with interruption segment, viewing into the interior of a closure cap, FIG. 3A is a view similar to that of FIG. 3, showing a plurality of interruption segments, FIG. 4 is a plan view of a sealing disc with a segment-like recess, FIG. 4A is a view similar to that of FIG. 4, showing a plurality of segment-like recesses, and FIG. 5 is a view in cross-section taken along line V—V in FIG. 4, on an enlarged scale.

The screw closure shown in FIG. 1 comprises a cap 1 which in turn essentially comprises a cap end portion 2 and a peripheral cap portion 3 provided with an internal screwthread 7. In addition, arranged at the lower edge of the closure is also a securing ring 10 which is damaged or torn off the cap 1 when the screw closure is released from a bottle for the first time.

The cross-sectional view in FIG. 1 is so selected that the cross-section of a bead 5 can be seen in the form of a rectangular projection on the left-hand side, while shown in section on the right-hand side is an interruption segment so that in that region the sealing disc 9 is not pressed downwardly and inwardly by the edge of the bead 5.

When such a closure is screwed onto the edge of the mouth opening of a bottle, a contact pressure occurs between the edge of the bead 5 and the upper outer edge of the mouth opening of the bottle, said edge being in opposite relationship to the edge of the bead 5; the contact pressure acts essentially only along the edge lines and is relatively high because, with a predetermined force with which the closure is screwed on, the pressure surface area is relatively small, as can also be seen from above-mentioned EP-A-OO 55 916.

In the interruption segment 6 however where the bead 5 is missing, the sealing disc 9 bears against the outer sealing edge of the mouth opening of the bottle, essentially only due to the stiffness of the sealing disc 9. It will be appreciated that the specific pressure in relation to surface area is lower at that location than along the oppositely disposed edges of the bead and the edge of the mouth opening of the bottle. Nonetheless an adequate sealing effect is also produced there as the segment extends only over a small angular region and the sealing disc still presses in that region more firmly than if the bead 5 were completely missing.

However in the region of the segment 6 the sealing disc 11 is not compressed or is compressed less strongly than along the edge of the bead 5 so that, when there is a correspondingly high pressure in the bottle, the sealing disc 11 can yield in that region and can allow an excessively high pressure to escape from the bottle, in which connection the screw thread 7 also has vent passages 8 which extend transversely with respect to the screwthread pitches and thus make it easier for discharged gases or liquids to escape.

It will be appreciated that the sealing disc 9 may also be of a somewhat larger diameter and may also in part bear along the inner wall of the peripheral cap portion 3 so that the seal can be produced in the region of the segment 6, not only along the upper surface of the closure edge portion but also from the outward side thereof.

For the sake of clarity, FIG. 2 again shows a similar view in cross-section of a closure, in which the sealing disc 9 has been omitted, so that the cross-section of the bead 5 can be clearly seen on the right-hand side; the bead manifests itself in a thickened cap end portion or peripheral cap portion wall, depending on the way in which the situation is considered, and forms a projecting corner which produces the increased linear contact pressure. A segment without a bead is once again shown in section on the opposite side of the closure shown in FIG. 2; in that segment, the cap wall portion 3 and the cap end portion 2 substantially retain the wall thickness that they otherwise present, and merge into each other with a slightly rounded 90° bend.

FIG. 3 is a view in horizontal section through a cap 1 in the region of the bead 5. The FIG. 3 view also clearly shows the wall thickness of the cap wall portion 3, which is greater in the region of the bead; the cap wall portion 3 is only of its normal dimension in the region of the interruption segment 6. Provided on the outward surface of the cap portion 3 is a corrugation configuration 12 which is intended to make the closure easier to screw on and off and which is also indicated in FIGS. 1 and 2 by the outer vertical lines on the peripheral cap portion 3. Alternatively, the bead 5 could include a plurality of interruption segments, as shown in FIG. 3A.

Instead of providing an interruption segment 6 in the bead however the top side 11 of the sealing disc 9 may also have a recess in a portion of the bead 5 so that accordingly in that region also the contact pressure of the sealing disc 11 against the closure edge portion of a bottle is lower than in the remaining region and an increased pressure can thus escape.

FIG. 5 shows a plan view of a sealing disc 9 with a recess 6' at its top side which is towards the cap end portion. The recess 6' can be seen in FIG. 5 in a cross-sectional view of the sealing disc 9. As can be seen, the sealing disc 9 remains practically unchanged on its sealing underside, although in the region of the recess 6 the sealing disc bears against the sealing edge of the edge portion of the mouth of a bottle substantially only due to the inherent stiffness of the sealing disc, while in the remaining region the projecting edge of a bead compresses the material of the sealing disc 9 and presses it against the outer edge of the edge portion of the mouth of the bottle. In the event of an excessively high pressure in the interior of the bottle, the sealing underside of the sealing disc lifts away from the edge of the mouth opening of the bottle in the region of the recess 6' and in that way allows the pressure to escape from the bottle until it is reduced to such an extent that the sealing disc bears against the edge of the edge portion of the mouth opening of the bottle again, by virtue of its elasticity. Alternatively, the disc 9 could include a plurality of recesses as shown in FIG. 4A.

I claim:

1. A screw closure of plastics material for bottles which are under pressure, comprising a cap (1) having a cap end portion (2) and a substantially cylindrical peripheral cap portion (3) with an internal screwthread (7), and a circumferentially extending, inwardly projecting bead (5) at a transition between the cap end portion (2) and the peripheral cap portion (3), wherein a sealing disc (9) which is movable relative to the cap bears against the inward side of the cap end portion (2) and the projecting bead (5), characterized in that the bead (5) has a segment-like interruption (6).

2. A screw closure according to claim 1 characterized in that the segment-like interruption of the bead extends over a circular arc ($\phi$) of at least 15°.

3. A screw closure according to claim 1 characterized in that the segment-like interruption extends over a circular arc ($\phi$) of about 60°.

4. A screw closure according to claim 3 characterized in that the segment-like interruption extends over a circular arc ($\phi$) of about 30°.

5. A screw closure according to claim 3 characterized in that the segment-like interruption extends over an angle ($\phi$) of about 45°.

6. A screw closure according to claim 1 characterised in that a plurality of segment-like interruptions (6) are arranged along the circumferentially extending bead (5).

7. A screw closure according to claim 6 characterised in that the segment-like interruptions each extend over respectively equal angular regions at respectively equal angular spacings from each other along the circumference of the bead.

8. A screw closure for bottles which are under pressure, comprising a cap (1) having a cap end portion (2) and a substantially cylindrical peripheral cap portion (3) with internal screwthread (7), wherein there is provided a sealing disc which is arranged substantially at the inward side of the cap end portion (2) and which is movable relative to the cap, the cap having a top side, a bottom side and an outer peripheral edge, the screw closure being characterized in that the sealing disc has at least one recess in the top side (11) extending only partially through the disc and facing the cap end portion, the recess being positioned in an edge region of the disc radially equidistant with the edge of the mouth of the bottle.

9. A screw closure according to claim 8 characterized in that the recess extends in the region of the outer edge of the sealing disc (9) over an angular region $\beta$ of at least 10°.

10. A screw closure according to claim 9 characterized in that the recess extends over an angular region $\beta$ of between 15° and 35°.

11. A screw closure according to claim 8 characterised in that the depth of the recess corresponds at least to half the thickness of the sealing disc (9) in the region beside the recess.

12. A screw closure according to claim 8 characterised in that a plurality of recesses are disposed along the circumferential region of the sealing disc (9).

13. A screw closure according to claim 12 characterised in that the recesses extend over respectively equal angular regions in the region of the outer edge of the recess and at respectively equal angular spacings from each other.

14. A screw closure for bottles which are under pressure, comprising a cap (1) having a cap end portion (2) and a substantially cylindrical peripheral cap portion (3) with an internal screwthread (7), said closure having a sealing disc arranged substantially proximate to said cap end portion (2) and said disc being movable relative to said cap, said cap having a top side, a bottom side and an outer peripheral edge, said screw closure being characterized in that said sealing disc has at least one recess in said top side (11) facing said cap end portion and radially positioned to overlie an edge of a bottle mouth, said recess extending only partially through said sealing disc thereby leaving said bottom side uninterrupted for seating against the bottle mouth.

15. The screw closure of claim 14, wherein said recess extends radially to said outer peripheral edge.

16. A screw closure according to claim 14 characterized in that the recess extends in the region of the outer edge of the sealing disc (9) over an angular region $\beta$ of at least 10°.

17. A screw closure according to claim 16 characterized in that the recess extends over an angular region $\beta$ of between 15° and 35°.

18. A screw closure according to claim 14 characterized in that the depth of the recess corresponds at least to half the thickness of the sealing disc (9) in the region beside the recess.

19. A screw closure according to claim 14 characterized in that a plurality of recesses are disposed along the circumferential region of the sealing disc (9).

20. A screw closure according to claim 19 characterized in that the recesses extend over respectively equal angular regions in the region of the outer edge of the recess and at respectively equal angular spacings form each other.

* * * * *

UNITED STATES PATENT AND TRADEMARK OFFICE

CERTIFICATE OF CORRECTION

PATENT NO. : 4,997,097

DATED : March 5, 1991

INVENTOR(S) : Gunter J. Krautkramer

It is certified that error appears in the above-identified patent and that said Letters Patent is hereby corrected as shown below:

Replace present Fig. 3 with attached Fig. 3.

Add new Fig. 3A.

Replace present Fig. 4, with attached Fig. 4.

Add new Fig. 4A.

Signed and Sealed this

Fourth Day of August, 1992

*Attest:*

DOUGLAS B. COMER

*Attesting Officer*

*Acting Commissioner of Patents and Trademarks*